US011161031B2

(12) United States Patent
Anning

(10) Patent No.: US 11,161,031 B2
(45) Date of Patent: Nov. 2, 2021

(54) ELECTRIC SKATEBOARDS

(71) Applicant: Evolve Skateboards Pty Ltd, Paradise Point (AU)

(72) Inventor: Jeffrey Anning, Paradise Point (AU)

(73) Assignee: EVOLVE SKATEBOARDS PTY LTD, Paradise Point (AU)

( * ) Notice: Subject to any disclaimer, the term of this patent is extended or adjusted under 35 U.S.C. 154(b) by 0 days.

(21) Appl. No.: 15/743,968

(22) PCT Filed: Mar. 21, 2017

(86) PCT No.: PCT/AU2017/050253
§ 371 (c)(1),
(2) Date: Jan. 11, 2018

(87) PCT Pub. No.: WO2018/170528
PCT Pub. Date: Sep. 27, 2018

(65) Prior Publication Data

US 2020/0009446 A1 Jan. 9, 2020

(51) Int. Cl.

| | |
|---|---|
| ***A63C 5/08*** | (2006.01) |
| ***A63C 17/12*** | (2006.01) |
| ***A63C 17/01*** | (2006.01) |

(52) U.S. Cl.
CPC ..... *A63C 17/12* (2013.01); *A63C 17/015* (2013.01); *A63C 17/012* (2013.01); *A63C 2203/12* (2013.01); *A63C 2203/18* (2013.01); *A63C 2203/22* (2013.01); *A63C 2203/24* (2013.01)

(58) Field of Classification Search
CPC ..... A63C 17/12; A63C 17/015; A63C 17/012; A63C 17/223; A63C 17/006; A63C 17/226; A63C 17/01; A63C 17/02; A63C 2203/12; A63C 2203/18; A63C 2203/22; A63C 2203/24; A63C 2203/42
See application file for complete search history.

(56) References Cited

U.S. PATENT DOCUMENTS

| | | | | |
|---|---|---|---|---|
| 5,020,621 A | | 6/1991 | Martin | |
| 5,645,291 A | * | 7/1997 | Ramage | A63C 17/0006 280/11.27 |
| 6,050,357 A | * | 4/2000 | Staelin | B60L 3/0092 180/65.1 |

(Continued)

FOREIGN PATENT DOCUMENTS

WO 2014/108275 A2 7/2014

OTHER PUBLICATIONS

Australian Patent Office, International Search Report for PCT Application No. PCT/AU2017/050253 (related to above-captioned patent application), dated Apr. 19, 2017.

(Continued)

*Primary Examiner* — James M Dolak
(74) *Attorney, Agent, or Firm* — K&L Gates LLP

(57) ABSTRACT

An electric skateboard comprising: a deck; a front truck and a rear truck; a pair of wheels rotatably connected to each truck, wherein one or both pairs of wheels are driven by sensored motors; a communications module configured to receive control instructions from a wireless remote control and to transmit data to one or more external devices; a controller in communication with the communication module and the motors; and a battery supplying power to the motors, communications module and controller.

24 Claims, 10 Drawing Sheets

(56) References Cited

U.S. PATENT DOCUMENTS

| | | | | |
|---|---|---|---|---|
| 9,004,213 | B2 * | 4/2015 | Larson | A63C 17/012 180/181 |
| 9,320,962 | B2 * | 4/2016 | Kreil | B60B 3/18 |
| 9,352,665 | B2 * | 5/2016 | Melvin | H02K 7/09 |
| 9,555,315 | B2 * | 1/2017 | Aders | A63C 17/12 |
| 9,616,318 | B2 * | 4/2017 | Rogers | A63C 17/12 |
| 9,908,032 | B2 * | 3/2018 | Garcia Elena | A63C 17/014 |
| 9,914,043 | B1 * | 3/2018 | Lu | A63C 17/12 |
| 9,950,243 | B2 * | 4/2018 | Evans | A63C 17/015 |
| 10,155,149 | B2 * | 12/2018 | Quinn | B60L 1/14 |
| 10,245,936 | B2 * | 4/2019 | Gillett | B62K 21/26 |
| 10,369,454 | B2 * | 8/2019 | Green | A63C 17/02 |
| 10,661,152 | B2 * | 5/2020 | Rogers | H02P 6/16 |
| 10,709,960 | B2 * | 7/2020 | Huang | A63C 17/12 |
| 10,814,211 | B2 * | 10/2020 | Pikulski | A63C 17/12 |
| 10,898,786 | B2 * | 1/2021 | Liniado | A63C 17/014 |
| 10,913,364 | B2 * | 2/2021 | Cho | B60C 9/00 |
| 10,926,159 | B1 * | 2/2021 | Smith | A63C 17/011 |
| 10,926,162 | B2 * | 2/2021 | Han | A63C 17/01 |
| 10,988,032 | B2 * | 4/2021 | Pang | B60L 15/2036 |
| 10,994,190 | B2 * | 5/2021 | Bluhm | B32B 9/046 |
| 11,027,187 | B2 * | 6/2021 | Rautiainen | B32B 9/047 |
| 2004/0078662 | A1 | 4/2004 | Hamel et al. | |
| 2008/0036617 | A1 | 2/2008 | Arms et al. | |
| 2010/0072759 | A1 | 3/2010 | Andosca et al. | |
| 2010/0222941 | A1 | 9/2010 | Chang | |
| 2010/0271199 | A1 | 10/2010 | Belov et al. | |
| 2013/0081891 | A1 * | 4/2013 | Ulmen | A63C 17/12 180/181 |
| 2013/0206493 | A1 | 8/2013 | Larson et al. | |
| 2014/0262574 | A1 | 9/2014 | Rodgers | |
| 2016/0206949 | A1 | 7/2016 | Murphy | |
| 2016/0296826 | A1 | 10/2016 | Belcher | |

OTHER PUBLICATIONS

Australian Patent Office, Written Opinion for PCT Application No. PCT/AU2017/050253 (related to above-motioned patent application), dated Apr. 19, 2017.

Michael Niedermayer, Wireless Condition Monitoring for Industrial Applications based on Radio Sensor Nodes with Energy Harvesting, International Journal on Advances in Networks and Services, vol. 7, No. 3 & 4, pp. 130-137.

* cited by examiner

26

ELECTRIC SKATEBOARDS

CROSS-REFERENCE TO RELATED APPLICATIONS

The present application is the National Stage of International Application No. PCT/AU2017/050253, filed Mar. 21, 2017, the disclosure of which is incorporated herein by reference.

FIELD

The present invention relates to electric skateboards.

BACKGROUND

Electric skateboards are becoming an increasingly popular commuting option, in response to widespread efforts in tackling traffic congestion and reducing pollution. Additionally, specially designed all-terrain or off-road electric models are becoming increasingly popular for recreational activities and action sports.

However, conventional electric skateboards are typically either heavy and bulky, or underpowered and therefore unsuitable for riding on more challenging terrain. Further, conventional skateboards typically have fixed configurations that limit the user's ability to adapt their skateboards according to changing needs. For example, a typical user may wish to use their skateboard for daily commuting, to practising carving and also for all-terrain riding.

In this context, there is a need for improved electric skateboards.

SUMMARY

According to the present invention, there is provided an electric skateboard comprising:

- a deck;
- a front truck and a rear truck;
- a pair of wheels rotatably connected to each truck, wherein one or both pairs of wheels are driven by sensored motors;
- a communications module configured to receive control instructions from a wireless remote control and to transmit data to one or more external devices;
- a controller in communication with the communication module and the motors; and
- a battery supplying power to the motors, communications module and controller.

At least one truck may comprise two brushless sensored motors, each connected via a drive belt to a drive gear of each of the driven wheels.

The electric skateboard may comprise four brushless sensored motors, each connected via a drive belt to a drive gear of each of the driven wheels.

Each sensored motor may comprise a hub motor.

The electric skateboard may comprise four sensored hub motors, one driving each wheel.

The electric skateboard may be convertible by a user between a street setup and an all-terrain setup by swapping between street wheels and all-terrain wheels.

Each wheel may be mounted on an axle that is configured to receive standard skateboard bearings, and hubs of the street wheels and the all-terrain wheels may be configured to fit standard skateboard bearings.

The communications module may comprise Bluetooth connectivity.

The one or more external devices may comprise the wireless remote control.

The communications module may transmit sensed data from one or all the motors to the one or more external devices, wherein the sensed data is used to compute skateboard speed, distance, acceleration, direction, range, duration of use, or a combination thereof.

The controller may comprise a processor for computing one or more skateboard parameters from sensed data received from the communications module, wherein the controller transmits the computed parameter(s) to the one or more external devices, and wherein the computed parameters comprise skateboard speed, distance, acceleration, direction, range, duration of use, or a combination thereof.

Computation of skateboard speed, distance and/or acceleration may take into account motor revolutions per minute (RPM), wheel size, drive gear size, or combinations thereof.

The communications module may transmit battery level data, total battery voltage, individual battery cell voltage, cell current draw, individual motor RPM, individual motor current draw or combinations thereof to the one or more external devices.

The wireless remote control may comprise a display screen for displaying sensed data transmitted from the communications module and/or parameters computed from the sensed data.

The wireless remote control may comprise a user interface for receiving user settings including wheel size, drive gear size, display preferences, or combinations thereof.

The communications module may transmit sensed data to a mobile computing device comprising a smartphone, a tablet or a laptop.

The communications module, controller and battery may be integrated into the deck. The deck may be manufactured of carbon fibre.

The electric skateboard may further comprise a battery holder on an underside of the deck, configured to removably receive the battery.

The combined rating of the motors may be 3000 watts, and the skateboard may be capable of speeds of about 35 kph.

The skateboard may be capable of being driven up slopes with gradients of up to about 25%.

According to another aspect of the present invention, there is provided a kit of parts comprising:

the electric skateboard as described; and a wireless remote control configured to pair with the controller.

The kit of parts may comprise a set of street wheels and a set of all-terrain wheels.

The kit of parts of may comprise one or more replacement batteries configured to be removably received in a battery holder on an underside of the skateboard deck.

BRIEF DESCRIPTION OF DRAWINGS

Embodiments of the invention will now be described by way of example only with reference to the accompanying drawings, in which.

DESCRIPTION OF EMBODIMENTS

Figure 1:
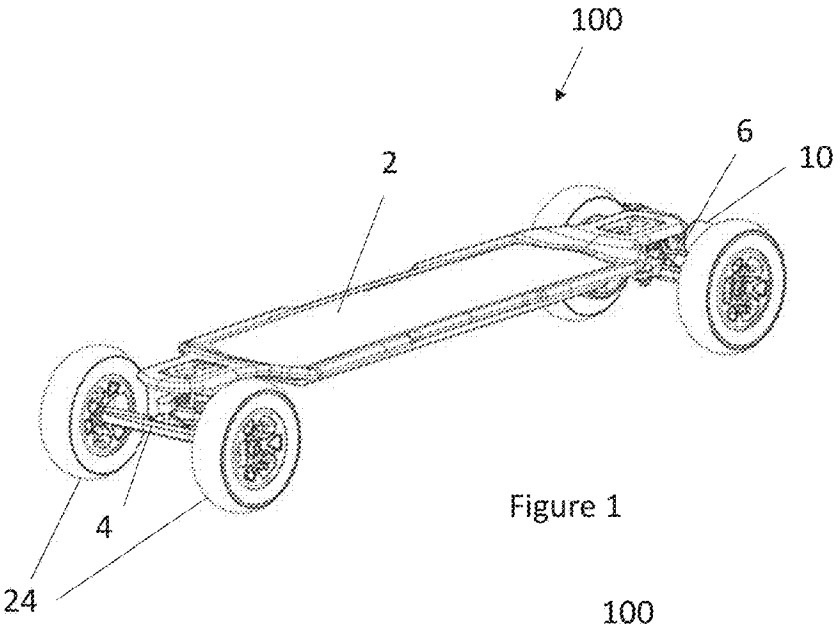
FIG. 1 is a perspective view of an electric skateboard fitted with all-terrain wheels according to one embodiment.

Referring to the drawings, an electric skateboard 100 according to one embodiment comprises a deck 2, a front truck 4 and a rear truck 6 attached to the deck, and a pair of wheels 22 or 24 rotatably connected to each truck 4, 6. The wheels of at least one of the pairs of wheels are driven by sensored motors.

Figure 5:
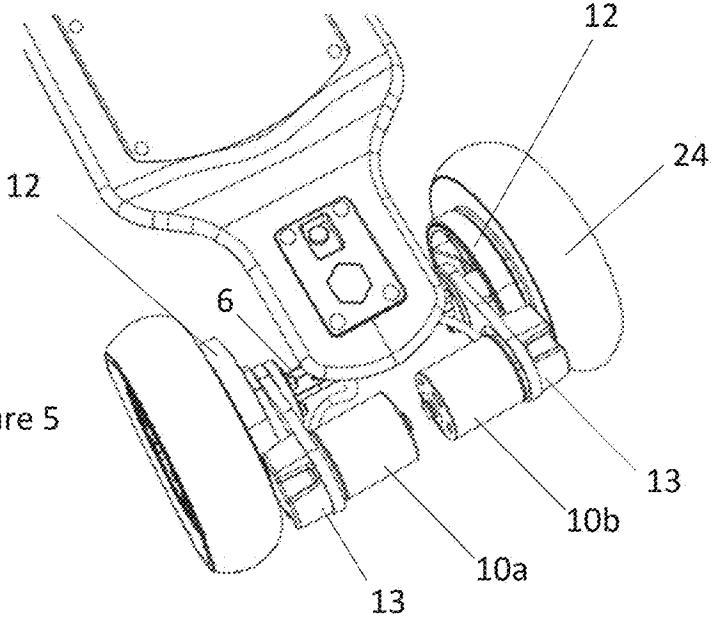
FIG. 5 is a detailed view of the rear truck of the skateboard of FIG. 1, illustrating the motor-driven wheels.

For example, in the embodiment illustrated in FIG. 5, at least one truck comprises two brushless sensored motors 10*a*, 10*b*, each motor connected via a drive belt 12 to a drive gear 34 of the wheel. As illustrated in the drawings, the motors 10 are on the rear truck 6; however it will be appreciated that it could be the front truck 4 or both trucks that is/are driven instead, ie the skateboard may comprises four motors in a four-wheel drive configuration.

Figure 11:
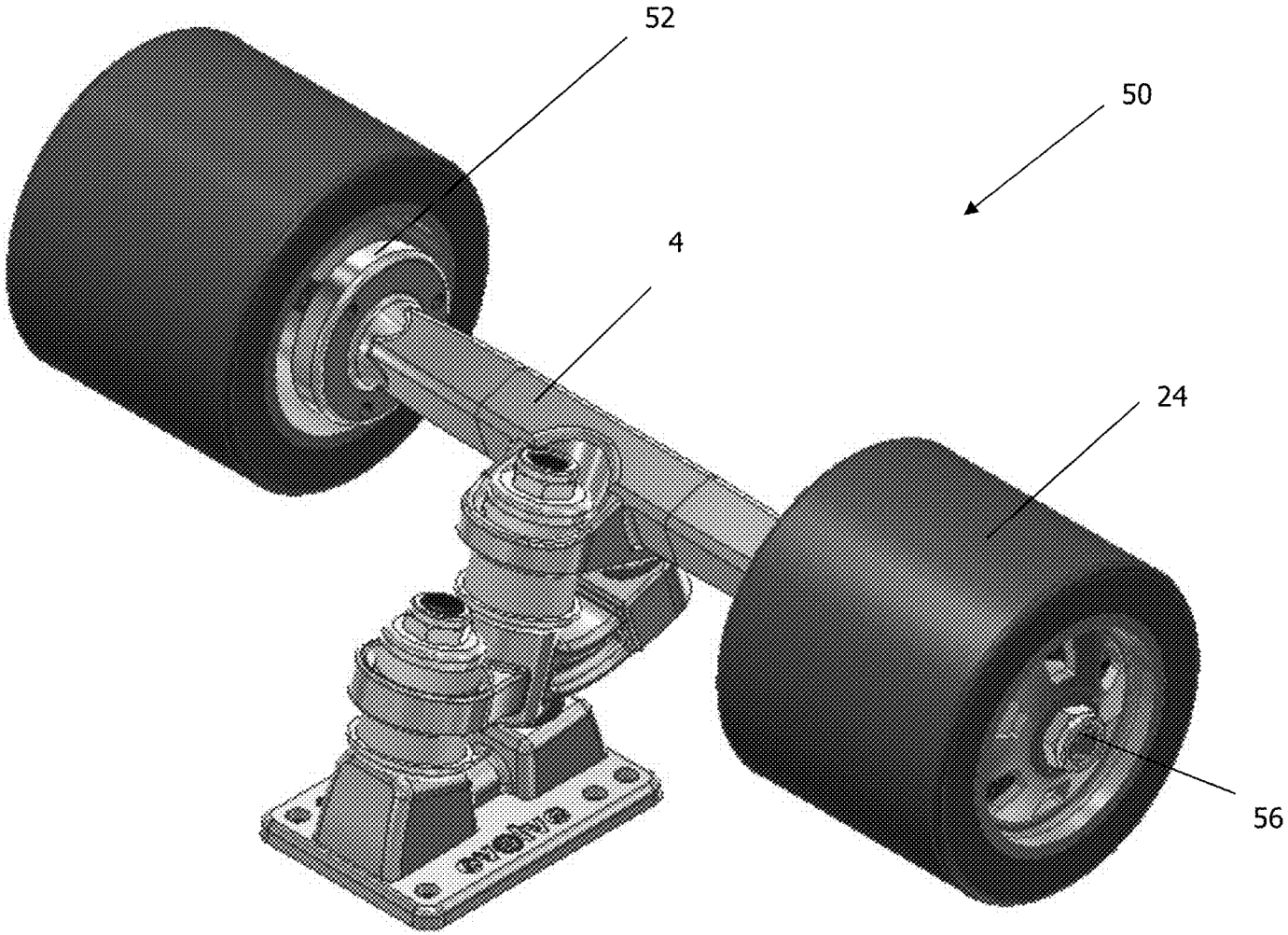
FIG. 11 is a perspective view of a wheel assembly for the electric skateboard according to another embodiment.
Figure 11:
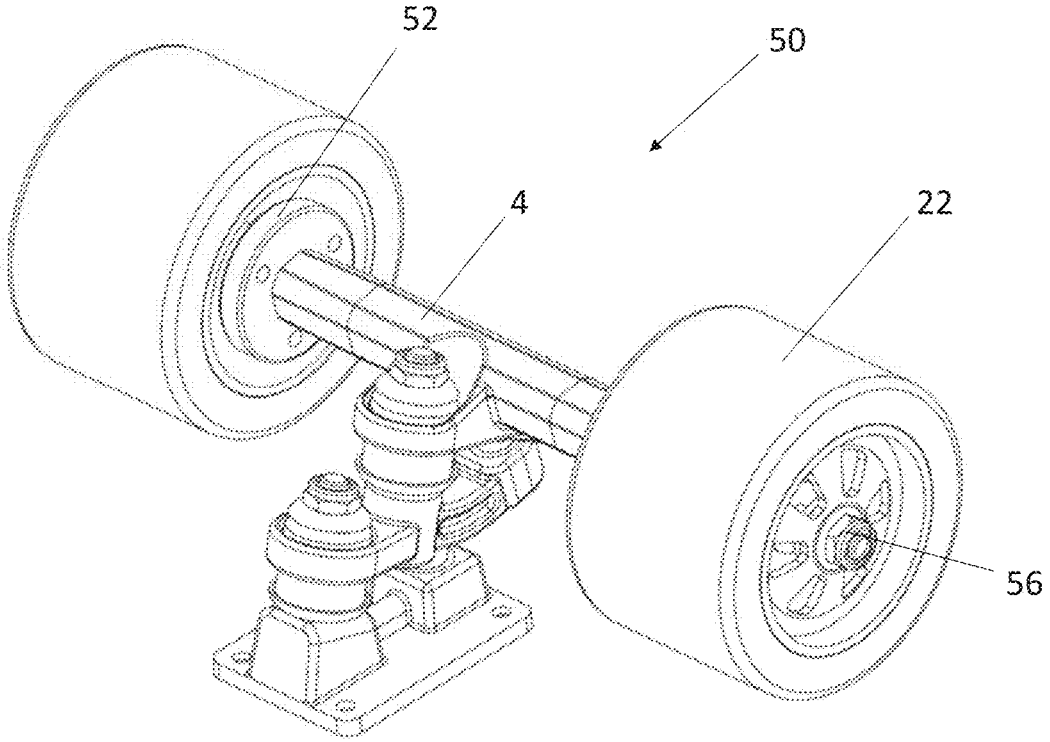
Figure 12:
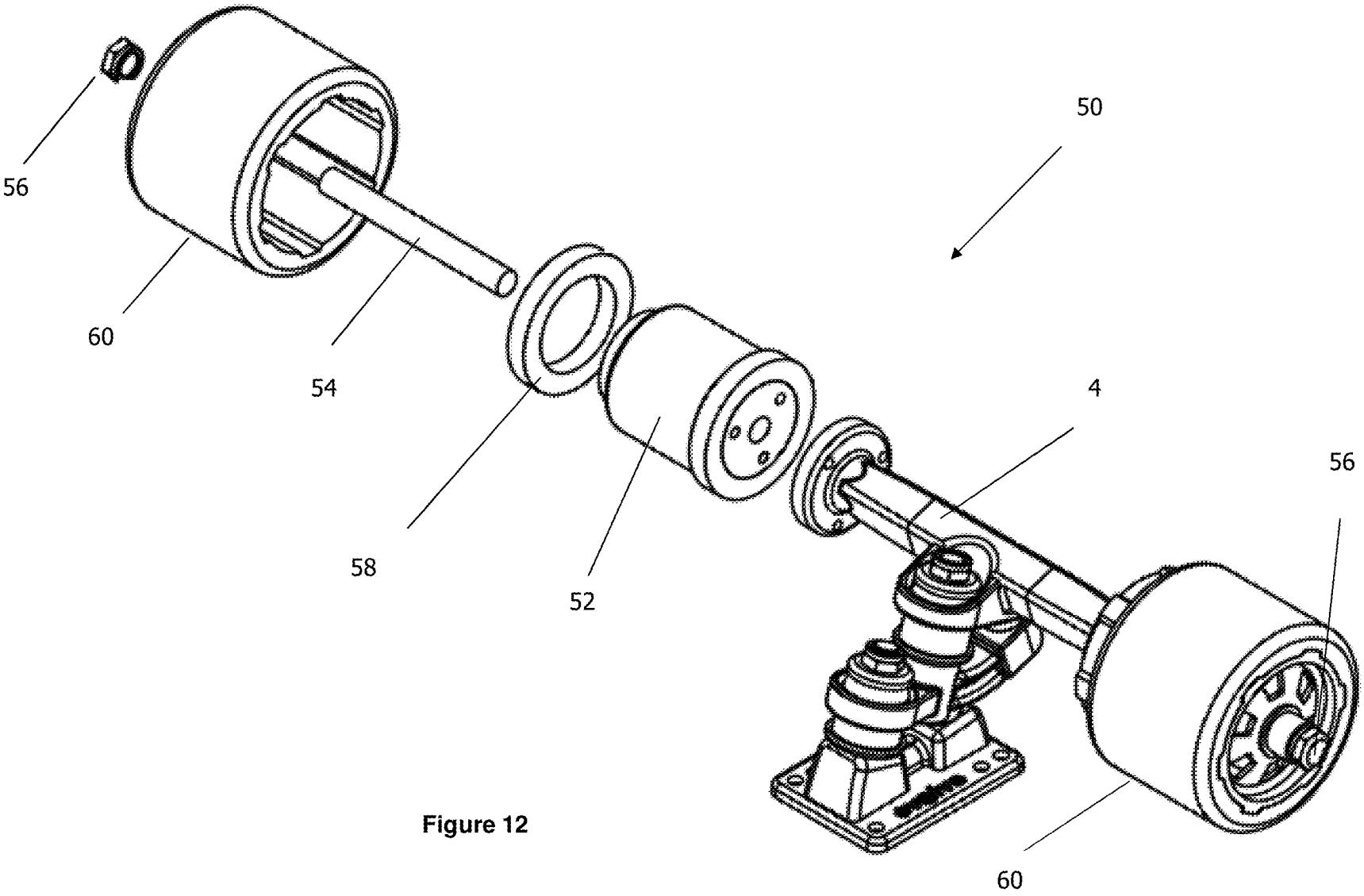
FIG. 12 is an exploded view of the wheel assembly of FIG. 11.

In another embodiment, as illustrated in FIGS. 11 and 12, the sensored motors may comprise hub motors 52 mounted within wheel 60. In some embodiments, the skateboard may comprise four sensored hub motors in a four-wheel drive configuration. The wheel assembly 50 may comprise a hub motor 52 mounted to each wheel 60 via axle 54 and hub adaptor 58. The axle 54 may be fastened to wheel 24 by axle mount 56. Use of a hub motor instead of belt-driven motors may improve aesthetics, reduce resistance from the drive system so that the skateboard may be manually kicked, and increase durability due to lack of the drive belt. The hub motors 52 may be directly driven or may comprise internal gears.

The skateboard 100 further comprises a communications module 14 that is configured to receive control instructions from a user via a wireless remote control 16, and also to transmit data to one or more external devices. In some embodiments, the external device is the wireless remote control 16. Additionally or alternatively, the communications module 14 transmits data to a mobile device such as a smartphone, a tablet or a laptop.

Figure 4:
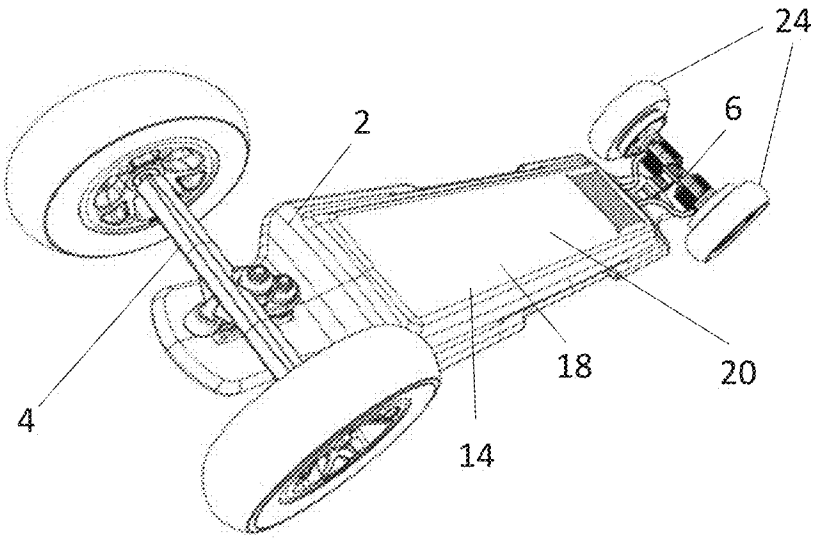
FIG. 4 is a perspective view of the underside of the skateboard of FIG. 1.
Figure 9:
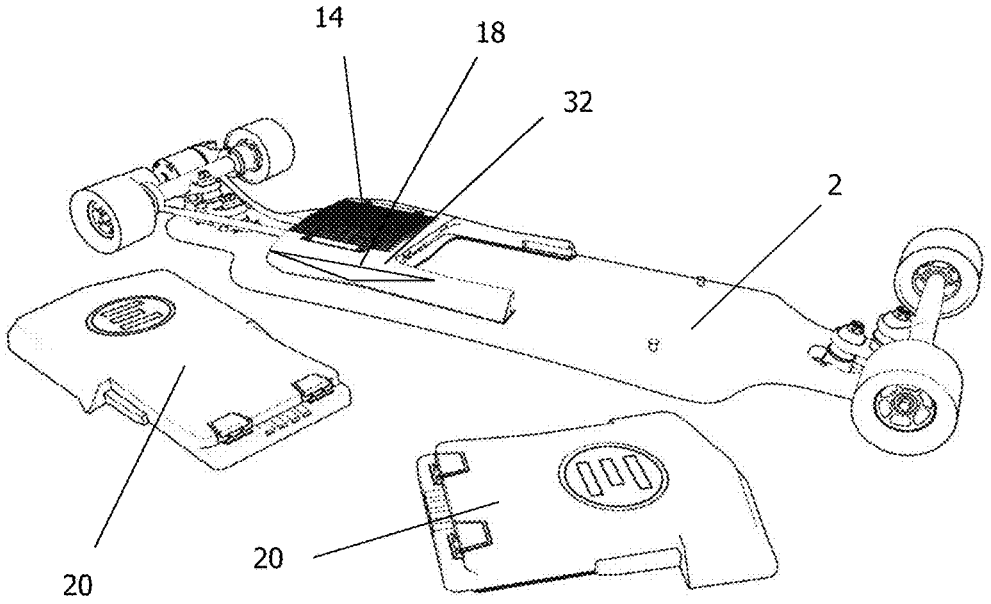
FIG. 9 is a perspective view of the skateboard of FIG. 8 with battery detached.

The skateboard also comprises a controller 18 that is in communication with the communication module 14 and the motors 10, and a battery 20 that supplies power to the motors 10, communications module 14 and controller 18. As illustrated in FIGS. 4 and 9, the communications module 14, controller 18 and battery 20 are preferably positioned on an underside of the deck 2.

FIG. 5 shows one embodiment of the rear truck 6 and driven wheels, with each motor 10*a*, 10*b* positioned above and rearward of the wheels 24. Each motor 10*a*, 10*b* is a brushless sensored motor driving a single wheel. The motors are attached in parallel to the wheel axles 36, and drive the wheels via drive belts 12. Belt covers 13 may be provided to protect the belts 12.

Figure 6:
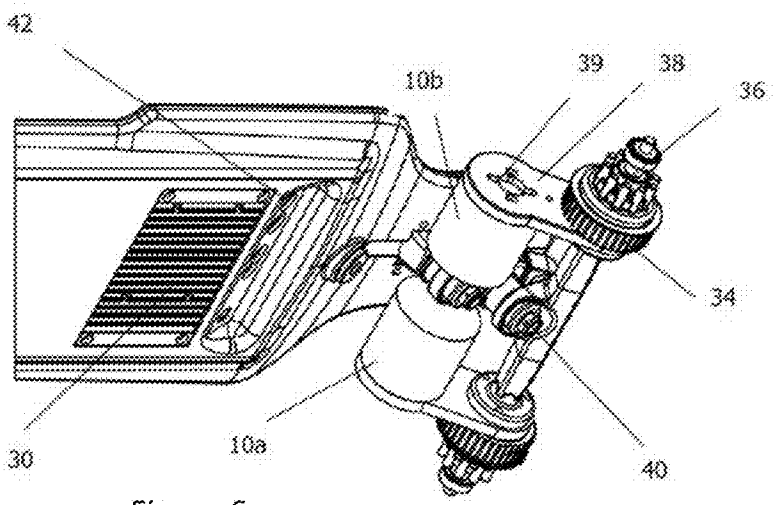
FIG. 6 is a detailed view of a skateboard truck with motor-driven wheels according to another embodiment.

FIG. 6 illustrates another embodiment of the rear truck 6, with the wheels removed to show motors 10*a*, 10*b* mounted on motor plates 38. In this embodiment, the motors 10 are positioned above and inwardly of the wheels to protect the motors in use. Horizontally extending mounting slot 39 allows for the distance between motor 10 and axle 36 to be adjusted depending on the size of the drive gear 34 and/or belt 12, to thereby allow for different sized wheels to be easily fitted, as described in more detail below.

In preferred embodiments, the combined power rating of the motors 10*a*, 10*b* is 3000 watts, and the skateboard 100 may be capable of top speeds of about 35 kph. It is envisaged that in some embodiments, eg when fitted with 97 mm wheels, the skateboard may have a top speed of about 42 kph. Additionally, the motors are preferably capable of driving the skateboard (with maximum user load of about 100 kg) up slopes with gradients of up to about 25%.

In preferred embodiments, the communications module 14 transmits sensed data from one or both the motors 10*a*, 10*b* to one or more external devices. The communications module 14 may comprise Bluetooth connectivity or any other suitable wireless connectivity to communicate with the remote control 16 and/or other external devices. The speed of the skateboard may therefore the computed accurately and in real time from the rotational speed of the motor, if the sizes of the driven wheel and associated drive gear are known. Accordingly, these measurements may be input by the user, during initial setup and after switching wheels. In some embodiments, this computation is performed on board the skateboard by the controller 18, and the speed data may be output to the external device in real time. In other embodiments, computation may be performed by the external device from sensed motor data transmitted via the communication module 14. The sensed data may additionally or alternatively be used to compute and display and/or record other parameters such as the distance travelled, acceleration, direction, range, duration of use, or a combination thereof.

Preferably, the charge level of battery 20 is also transmitted to the remote control 16 and displayed to the user in real time. The skateboard 100 may additionally comprise other sensors such as global positioning system (GPS) sensors, temperature sensors, weight sensors, cameras, etc, and the data captured may likewise be transmitted via the communication module 14 to the external device.

Figure 7A:
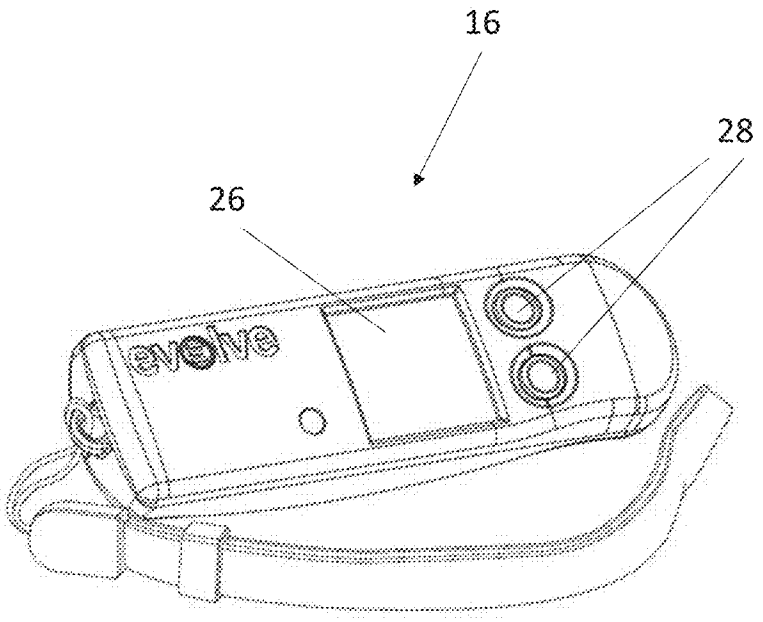
FIG. 7*a* is a perspective view of a wireless remote control for controlling the electric skateboard according to one embodiment.
Figure 7B:
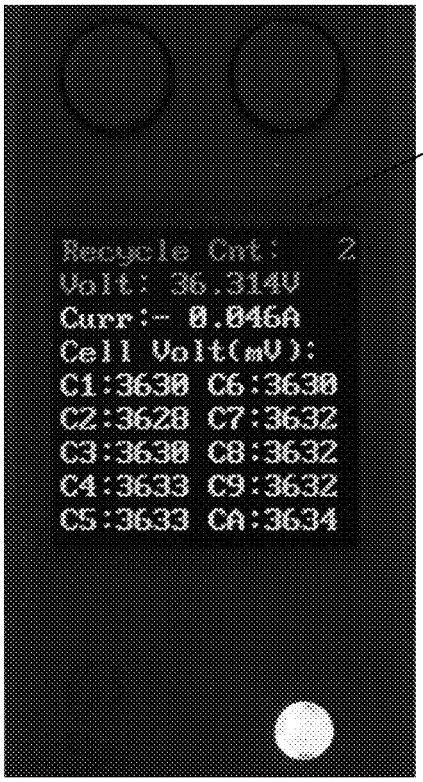
FIGS. 7*b* and 7*c* are example user interfaces of the wireless remote control illustrating remote diagnostics displays for the battery and motor respectively.
Figure 7C:
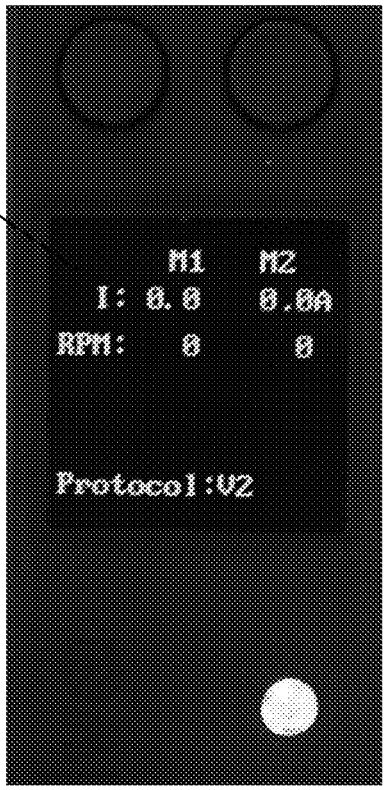

In some embodiments, vital data about the electronic performance of the skateboard 100 may be transmitted to the remote control 16 and/or other external device. For example, performance data of battery 20, such as total battery voltage, individual cell voltage and current draw, etc, may be transmitted, stored, and/or displayed on the remote control 16 or other external device, as illustrated in FIG. 7*b*. In another example, performance data of each motor 10, such as individual motor RPM and individual motor current draw, may be transmitted, stored, and/or displayed on the remote control 16, as illustrated in FIG. 7*c*. This data may be accessed by technicians in order to more quickly and conveniently diagnose issues or fine tune performance. In preferred embodiments, this data is stored on and accessible from the remote control 16 and/or other external device, so issues can be diagnosed by a technician without having to view the actual skateboard.

While riding the skateboard, the user transmits control instructions in real time to the controller 18 via the wireless remote control 16. Control instructions may include activation or deactivation of the motors 10, speed levels, direction of travel (ie forward or reverse), instructions to brake, or combinations thereof. The remote control 16 comprises a user interface, for example, buttons 28, a touch screen, a joystick, trigger device, etc., for receiving user input. The user interface may also be used to enter other settings such as the current skateboard wheel size, current skateboard gear size, display preferences, etc.

In preferred embodiments, the remote control 16 comprises a display screen 26, such as a liquid crystal display (LCD) screen, for displaying data to the user. Additional or alternative user display interfaces may include coloured light emitting diodes (LEDs), speakers, haptic feedback, or combinations thereof.

Data may also be transferred to other external devices such as a smartphone, a tablet, a laptop, etc. For example, the mobile device may run a mobile application that may be used to collect, display and store usage data about the skateboard 100, such as the distance travelled, tracked or saved trips, top speeds, etc. The mobile app may also be used to track and/or display the number of users in a specified area, for example, the app may provide a map visualisation of the number and location of connected users at a given time. The collected usage data may be stored at a cloud database server that may be accessed by the user and/or skateboard manufacturers, suppliers, marketers, sports organisations, etc. The mobile app may provide one or more application programming interfaces (APIs) to interface with other mobile and/or web applications or data stores, such as social networking applications, online advertising applications, e-commerce applications, etc.

Figure 2:
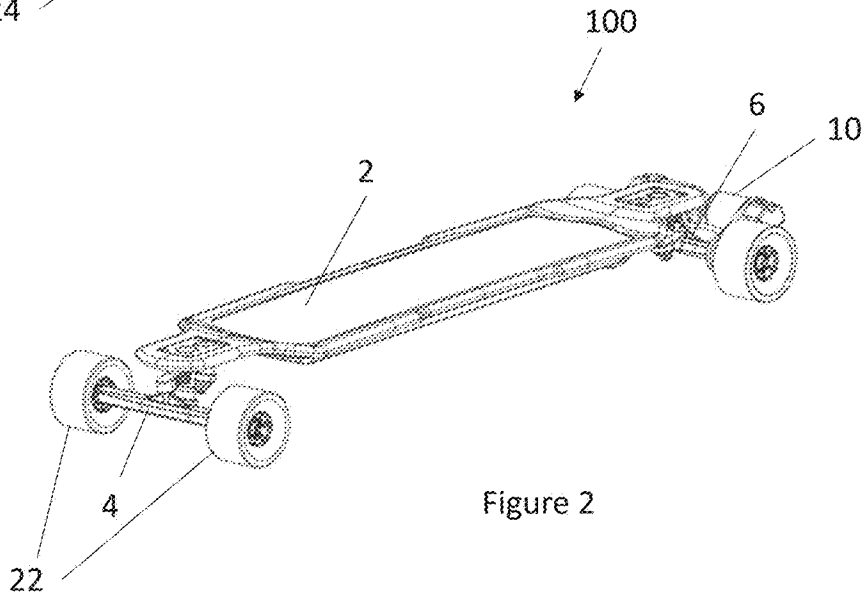
FIG. 2 is a perspective view of the electric skateboard of FIG. 1 fitted with street wheels according to one embodiment.
Figure 3:
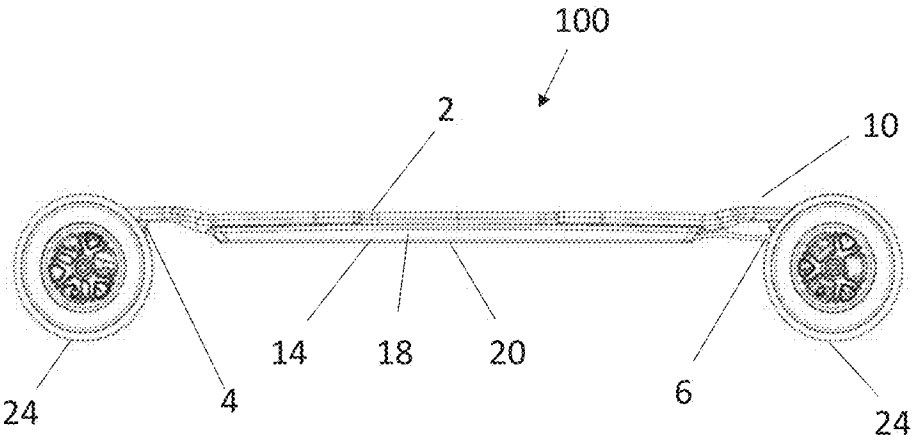
FIG. 3 is a side elevation view of the electric skateboard of FIG. 1.

In a preferred embodiment as shown in FIGS. 1 and 2, the skateboard 100 is convertible by the user between a street setup and an all-terrain setup by simply swapping between street wheels 22 and all-terrain wheels 24, and their associated drive gears. Each wheel is mounted on an axle 36 that is configured to receive standard "608" skateboard bearings, and the hubs of the street wheels 22 and the all-terrain wheels 24 are configured to fit the standard "608" bearings. This configuration also allows the user to easily replace worn out wheels without having to remove or modify the trucks 4, 6 or the motors 10.

In one embodiment, the method for converting the rear drive truck 6 between a street setup as shown in FIG. 2 and an all-terrain setup as shown in FIG. 1 comprises removing belt covers 13 in order to detach the street wheels 22 and street drive belts 12 from the truck. The all-terrain drive gears 34 and drive belts 12 may then be installed. This may involve adjusting the distance between motor 10 and the axle 36, by adjusting the position of the motor 10 along mounting slot 39 on motor plate 38. The all-terrain wheels 24 may then be installed on the drive gears 34, and the belt covers 13 replaced. The wheels on the non-driven truck may be converted by simply replacing the street wheels 22 with the all-terrain wheels 24. Preferably, converting the all-terrain setup to the street setup involves equivalent methods steps.

In some embodiments, as illustrated in FIGS. 1 to 6, the communications module 14, controller 16 and battery 20 are integrated into the deck 2, preferably on an underside of the deck. The deck is preferably moulded of carbon fibre in a custom-made mould that allows the electronic components to be integrally built into the deck 2. This enables the electric skateboard to be substantially weather-resistant and/or water resistant in some embodiments. FIG. 6 shows the underside of the carbon fibre deck according to one embodiment, comprising a heat sink 30, power charging socket 42, and user interface components such a power button, LED indicators, etc. The specific selection and arrangement of electronic components within the specially designed deck 2 allows for a slimline and streamlined build (as shown more clearly in FIG. 3). There are no protruding or hanging components below the deck that would be susceptible to damage or obstruct movement when riding on uneven terrain.

Figure 8:
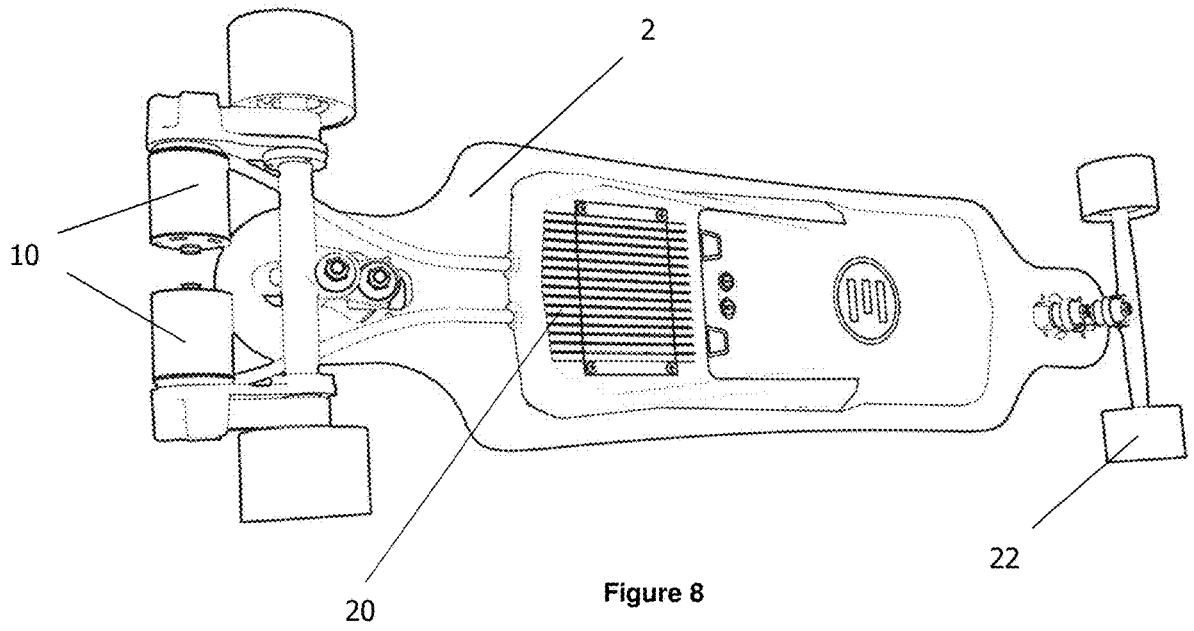
FIG. 8 is a bottom view of an electric skateboard according to another embodiment.
Figure 10:
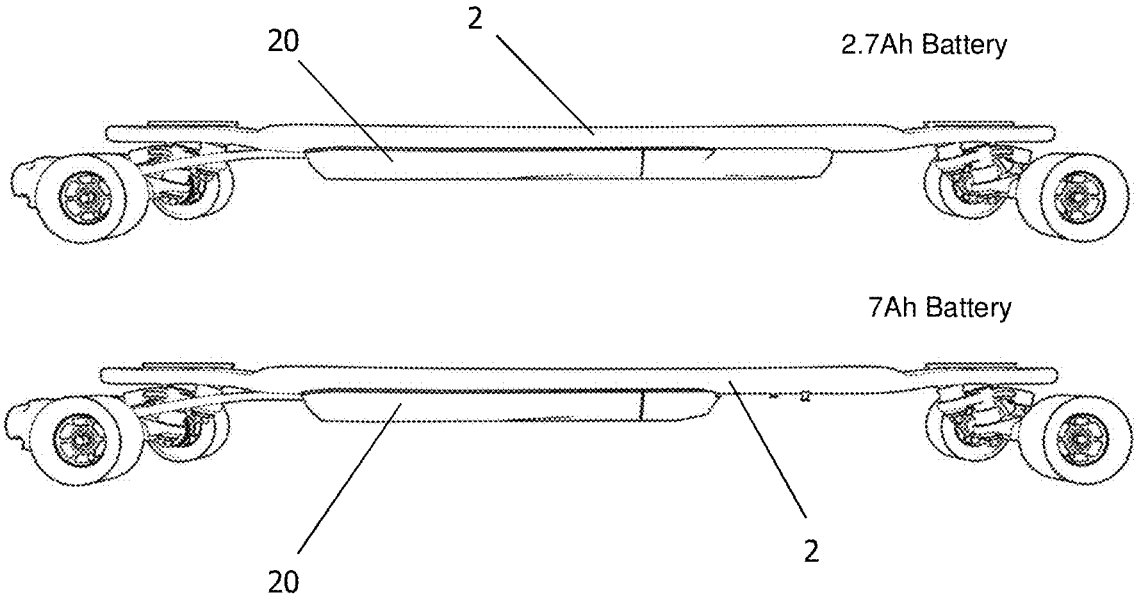
FIG. 10 shows side elevation views of the skateboard of FIG. 8, fitted with different types of batteries.

In other embodiments, as illustrated in FIGS. 8 to 10, the electric skateboard 10 may comprise a battery holder 32, configured to removably receive the battery 20. Preferably, the battery holder 32 is positioned on the underside of the deck 2, to attach the battery on the underside of the deck. As shown in FIGS. 9 and 10, the battery holder 32 may be configured to receive different batteries eg having different capacities. It will be appreciated that this feature allows for the user to quickly and conveniently replace depleted batteries while on the go. The other electronic components such as the communications module 14 and controller 16 may be attached underneath the deck 2, for example, within a case that is integral with the battery holder 32 as shown in FIG. 9. Alternatively, the communications module 14 and controller 16 components may be integrally built into the deck 2.

Similarly to the embodiment of FIGS. 1 to 6, the battery 20, battery holder 32 and electronic components are selected, arranged and configured to provide a slimline build, even with a large capacity 7 Ah battery, as shown in FIG. 10. The specific design additionally results in a lightweight and portable skateboard 100, weighing preferably less than about 10 kg.

Preferred embodiments of the electric skateboard 100 driven by 3000 watt motors may provide up to about a 20 km range on a fully charged battery. In some cases, for example with a street setup at a relatively steady speed and on relatively flat terrain, the skateboard may provide up to about a 50 km range.

The present invention may alternatively be provided as a kit of parts comprising the electric skateboard 100 and a wireless remote control 6 configured to pair with the controller. The kit may also comprise one or more sets of replacement wheels, for example a set of street wheels and a set of all-terrain wheels. In some embodiments, where the battery 20 is removably mounted via battery holder 32, the kit may alternatively or additionally comprise additional batteries.

Embodiments of the present invention provide electric skateboards that are useful for adapting to changing needs of the user, eg a skateboard that may be switched quickly and easily between a street setup for daily commuting, and an all-terrain setup for recreation.

For the purpose of this specification, the word "comprising" means "including but not limited to", and the word "comprises" has a corresponding meaning.

It is to be understood that other specific arrangements of parts, example devices, systems, and environments may be used and structural and functional modifications may be made without departing from the scope of the present invention. Also, while the terms "above", "below", "top", "bottom", "front", "back", "rear", "side", "vertical", "lateral", and the like may be used in this specification to describe various example features and elements of the invention, these terms are used herein as a matter of convenience; eg, based on the example orientations shown in the figures. Nothing in this specification should be construed as requiring a specific three dimensional orientation of structures in order to fall within the scope of this invention.

The above embodiments have been described by way of example only and modifications are possible within the scope of the claims that follow.

The invention claimed is:

1. An electric skateboard comprising:

a deck including a moulded body;

a front truck and a rear truck;

a first pair of wheels rotatably connected to the front truck and a second pair of wheels rotatably connected to the rear truck, the first pair of wheels rotatably connected on two ends of a first axle, the second pair of wheels rotatably connected on two ends of a second axle, wherein the first pair of wheels are driven wheels, driven by sensored motors;

a communications module configured to receive control instructions from a wireless remote control and to transmit data to one or more external devices;

a controller in communication with the communications module and the sensored motors; and a battery supplying power to the motors, communications module and controller, the communications module, the controller and the battery are integrated within the moulded body and are provided on an underside of the deck, the first axle supports two motor mounting plates configured for adjustably mounting the sensored motors thereto such that a distance between the sensored motors and the first axle is adjustable, one of the two motor mounting plates supported toward one end of the first axle, and the other of the two motor mounting plates supported toward the other end of the first axle.

2. The electric skateboard of claim 1, wherein at least one of the front truck or the rear truck comprises two brushless sensored motors, each motor connected via a drive belt to a respective first and a respective second wheel of the driven wheels.

3. The electric skateboard of claim 1, wherein each sensored motor comprises a hub motor.

4. The electric skateboard of claim 1, convertible by a user between a street setup and an all-terrain setup by swapping between street wheels and all-terrain wheels.

5. The electric skateboard of claim 4, wherein each of the first axle and the second axle receives standard skateboard bearings for mounting the first and second pairs of wheels thereto, and wherein hubs of the street wheels and the all-terrain wheels are configured to fit standard skateboard bearings.

6. The electric skateboard of claim 1, wherein the communications module comprises Bluetooth connectivity.

7. The electric skateboard of claim 1, wherein the one or more external devices comprises the wireless remote control.

8. The electric skateboard of claim 1, wherein the communications module transmits sensed data from one or all the motors to the one or more external devices, wherein the sensed data is used to compute at least one of skateboard speed, distance, acceleration, direction, range, and duration of use.

9. The electric skateboard of claim 1, wherein the controller comprises a processor for computing one or more skateboard parameters from sensed data received from the communications module, wherein the controller transmits the computed parameter(s) to the one or more external devices, and wherein the computed parameters comprise at least one of skateboard speed, distance, acceleration, direction, range, and duration of use.

10. The electric skateboard of claim 8, wherein computation of at least one of skateboard speed, distance and acceleration takes into account at least one of motor RPM, wheel size, and drive gear size.

11. The electric skateboard of claim 1, wherein the communications module transmits at least one of battery level data, total battery voltage, individual battery cell voltage, cell current draw, individual motor RPM, and individual motor current draw to the one or more external devices.

12. The electric skateboard of claim 1, wherein the wireless remote control comprises a display screen for displaying at least one of (i) sensed data transmitted from the communications module or (ii) parameters computed from the sensed data.

13. The electric skateboard of claim 1, wherein the wireless remote control comprises a user interface for receiving user settings including at least one of wheel size, drive gear size, and display preferences.

14. The electric skateboard of claim 1, wherein the communications module transmits sensed data to a mobile computing device comprising a smartphone, a tablet or a laptop.

15. The electric skateboard of claim 1, wherein the deck is manufactured of carbon fibre.

16. The electric skateboard of claim 1, wherein the combined rating of the motors is 3000 watts, and wherein the skateboard is capable of speeds of about 35 kph.

17. The electric skateboard of claim 1, wherein the skateboard is capable of being driven up slopes with gradients of up to about 25%.

18. A kit of parts comprising:

the electric skateboard of claim 1; and a wireless remote control configured to pair with the controller.

19. The kit of parts of claim 18, comprising a set of street wheels and a set of all terrain wheels.

20. The kit of parts of claim 18, further comprising one or more replacement batteries configured to be removably received in a battery holder on an underside of the skateboard deck.

21. The electric skateboard of claim 1, wherein the underside of the deck includes a heat sink.

22. The electric skateboard of claim 1, wherein there are no protruding or hanging components below the deck.

23. The electric skateboard of claim 1, wherein the controller and the battery are integrated within the moulded body on the underside of the deck in a streamlined configuration.

24. The electric skateboard of claim 1, wherein each motor mounting plate comprises a mounting slot configured to allow for the distance between the sensored motors and the first axle to be adjustable.

* * * * *